US009790756B2

(12) United States Patent
McNeilly

(10) Patent No.: US 9,790,756 B2
(45) Date of Patent: Oct. 17, 2017

(54) WIRELINE DOWN JAR

(71) Applicant: Keith McNeilly, Houma, LA (US)

(72) Inventor: Keith McNeilly, Houma, LA (US)

( * ) Notice: Subject to any disclaimer, the term of this patent is extended or adjusted under 35 U.S.C. 154(b) by 898 days.

(21) Appl. No.: 14/065,091

(22) Filed: Oct. 28, 2013

(65) Prior Publication Data

US 2015/0114643 A1 Apr. 30, 2015

(51) Int. Cl.
*E21B 31/113* (2006.01)
*E21B 31/107* (2006.01)

(52) U.S. Cl.
CPC ..... *E21B 31/1135* (2013.01); *E21B 31/107* (2013.01); *E21B 31/113* (2013.01)

(58) Field of Classification Search
CPC ... E21B 31/107; E21B 31/113; E21B 31/1135
See application file for complete search history.

(56) References Cited

U.S. PATENT DOCUMENTS 4,462,471 A * 7/1984 Hipp ..... E21B 31/113 175/296
5,803,182 A * 9/1998 Bakke ..... E21B 31/113 173/137
6,308,779 B1 * 10/2001 McNeilly ..... E21B 31/113 166/178
7,044,240 B2 5/2006 McNeilly
7,299,872 B2 11/2007 Darnell
2005/0000735 A1 * 1/2005 Darnell ..... E21B 31/1135 175/296
2005/0150693 A1 * 7/2005 Madden ..... E21B 31/107 175/298
2006/0054322 A1 * 3/2006 Rose ..... E21B 31/1135 166/301
2011/0297380 A1 * 12/2011 Alberty ..... E21B 31/113 166/301

* cited by examiner

*Primary Examiner* — Waseem Moorad
*Assistant Examiner* — Christopher Sebesta
(74) *Attorney, Agent, or Firm* — Bracewell LLP; James E. Bradley

(57) ABSTRACT

A jar assembly for use downhole includes a housing, a piston assembly slidable within and selectively coupled to the housing, a mandrel assembly coupled on a lower end of the piston assembly, and an anvil coupled to an end of the mandrel assembly opposite the piston assembly. The jar assembly is deployed in a wellbore by a conveyance means that couples with the housing. A hydraulic circuit in the piston assembly activates a latch for decoupling the piston assembly from the housing; when decoupled, the housing slides downward and impacts the anvil to generate a jarring force. The jar assembly is re-cocked by raising it with the conveyance means.

20 Claims, 5 Drawing Sheets

WIRELINE DOWN JAR

FIELD OF THE INVENTION

The present disclosure relates to downhole oil and gas equipment, and in particular to a mechanical type jarring or impact device used deliver downward impact.

BACKGROUND OF THE INVENTION

Many different types of wire are utilized to perform a wide variety of tasks within the bore of a well; which are collectively referred to as wireline. Common terms for the various types of wireline include slickline, braided line, electric line, logging cable, or simply cable. Wireline is typically spooled onto a winch and fed into a well over sheaves that center the wire vertically over the well. Wireline tool strings are sometimes deployed downhole on wireline; where the tool strings include various tools connected together and which occasionally include weights. The weight of the tool string pulls the wire from the winch and thus gravity feeds into the well. Because the well bore is often pressurized, a pack off assembly is typically installed at the wellbore opening to create a seal around the wire and contain the wellbore pressure. When deploying wire into a pressurized well bore, the tool string must weigh enough so the force of gravity on the tool string exceeds the resistive force generated by well pressure acting on the area of the wire.

Many wellbore operations require an impact to achieve the desired result. Whenever impact is required, tools commonly referred to as jars are installed in the tool string. Jars work much the same as a slide hammer whereby some components are arranged to freely travel a certain distance (stroke), and then impact a shoulder; which instantly halts the upward or downward motion of the tool strings mass thereby creating an impact force. Manipulating jars to create an impact usually requires rapidly manipulating the winch when raising or lowering the tool string, thereby rapidly hoisting or dropping the mass of the tool string. One of the aforementioned sheaves normally contains or is attached to a load cell device that measures the strain on the wire displaying the weight of the wire and tool string. The load cell is usually constantly monitored as the wire is lowered or hoisted within the well bore. Contact with an obstruction that impedes or stops the descent of the tool string is detected by observing a rapid loss of weight on the load cell display. Conversely, when hoisting the wire, the load cell will display a rapid increase in weight if the ascent of the tool string is impeded or halted. While manipulating the winch to deliver an impact, the load cell is monitored for an indication that the jars have reached the end of their free stroke. At the end of the free stroke, winch rotation must stop instantly to prevent damage to the wireline.

Rapidly manipulating the winch to create impact requires skill, and is sometimes problematic due to the wire reciprocating through the sheaves at a high rate of speed. Continued reciprocation, particularly at high speed, can cause wire breakage or fatigue. Lowering the winch rapidly may cause excessive slack in the wire and result in a loosely wound winch or cause the wire to jump out of a sheave. As the wire is lowered by the winch, the wire is stripped through the pack off and drags on the walls of the well bore which tends to impede the descent of the tool string thus dampening downward impact. Furthermore, because wireline cannot effectively push or shove, downward impact is dependent upon the skill of the winch operator, gravity, mass of the tool string, and speed of the winch.

Slow winch rotation to manipulate jars in an upward direction is achieved by utilizing special types of jars. These upward acting jars are commonly referred to as hydraulic jars, oil jars, spring jars, detent jars, or mechanical jars. Briefly explained, these upward jars freely stroke to the closed or downward position but oppose tension until a pre-determined load or time interval is reached. Once the pre-determined load or time interval is reached, the upward acting jar will release and allow the energy stored in the tensioned wire to rapidly move the mass of the tool string upward creating an impact. Because of the energy stored in the tensioned wire, very high upward impact forces can be achieved with these types of jars.

SUMMARY

Disclosed herein is an example of a device and method of generating a jarring impact downhole. In one embodiment disclosed is a jar assembly that includes an annular housing, an elongated mandrel in selective telescoping relationship with the housing, an anvil coupled with an end of the mandrel, and a piston assembly coupled with the mandrel. In this example the piston assembly includes a latch assembly that is selectively reconfigured from a latching position coupled to the housing to an unlatched position, and that is slidable in the housing when decoupled from the housing, so that when substantially all the weight of the jar assembly is supported by the mandrel, the latch assembly moves into the unlatched position, and the housing slides axially with respect to the mandrel into impacting contact with the anvil. The piston assembly can include a piston with a piston head that inserts into a reservoir having a fluid, a passage formed in the piston head so that portions of the reservoir on opposing sides of the piston head are in fluid communication. In an example, when the jar assembly is supported by the mandrel, the piston is urged upward within the reservoir for moving the latch assembly into the delatching configuration thereby decoupling the piston assembly from the housing. The latch assembly may further include a lug housing having a radially oriented slot, and a lug moveable within the slot and into interfering contact with a shoulder formed on an inner surface of the housing to couple the housing with the piston assembly. An end of the lug can be in contact with a piston body that depends from the piston head and that has a varying diameter, so that when a reduced diameter portion of the piston body is moved adjacent the lug, the lug moves radially inward and out of interfering contact with the shoulder on the inner surface of the housing to decouple the piston assembly from the housing. In an alternate example, the piston assembly includes a piston having a piston body, a piston head having a diameter greater than a diameter of the piston body and that selectively reciprocates within a reservoir having a fluid, a passage in the piston head provides a path for fluid flow when the piston head reciprocates within the reservoir, and a bore axially extending through the piston head and into the piston body that defines a bypass to the passage. This embodiment can further include a check valve in the bore. A conveyance means for deployment within a wellbore can be coupled with the housing.

Another example of a jar assembly for use downhole includes a housing, an elongated mandrel selectively coupled with the housing, an anvil mounted on an end of the mandrel, and a means for decoupling the housing from the mandrel when the housing is lowered onto and is supported by the mandrel. In this example when the housing is decoupled from the mandrel, the housing is slidable along the mandrel and impacts against the anvil for generating a jarring impact in a downhole device coupled to the jar assembly. The means for decoupling the housing from the mandrel can include a piston assembly with a piston that is hydraulically urged into an unlatching position for allowing a lug to move radially inward from latching cooperation with the housing thereby decoupling the housing from the mandrel. The jar assembly can further include a decoupling flow path formed in the piston, and a recocking flow path formed in the piston, wherein fluid flows in the decoupling flow path when the housing is being decoupled from the mandrel, and wherein fluid flows in the recocking flow path when the housing is being recoupled with the mandrel. In one example, a flow rate of fluid flowing in the decoupling flow path is less than a flow rate of fluid flowing in the recocking flow path. Optionally, lowering the housing in a wellbore and supporting the housing on the mandrel initiates the jarring impact.

A method is disclosed herein of applying a jarring impact downhole, where in an example the method includes providing a jar assembly made up of a mandrel, a housing selectively coupled to and slidable on the mandrel, and an anvil on an end of the mandrel. The method further includes lowering the jar assembly downhole so that the weight of the housing is supported by the mandrel, decoupling the housing from the mandrel in response to the weight of the housing being supported on the mandrel, and sliding the housing down the mandrel and into jarring impact with the anvil. The step of decoupling the housing from the mandrel can be completed in a designated period of time after the housing is lowered onto the mandrel. The method may further include mounting a downhole tool to the jar assembly and optionally include recocking the jar assembly by raising the jar assembly. Radially projecting lugs can be used for coupling the housing to the mandrel.

DETAILED DESCRIPTION OF THE DISCLOSURE

Figure 1:
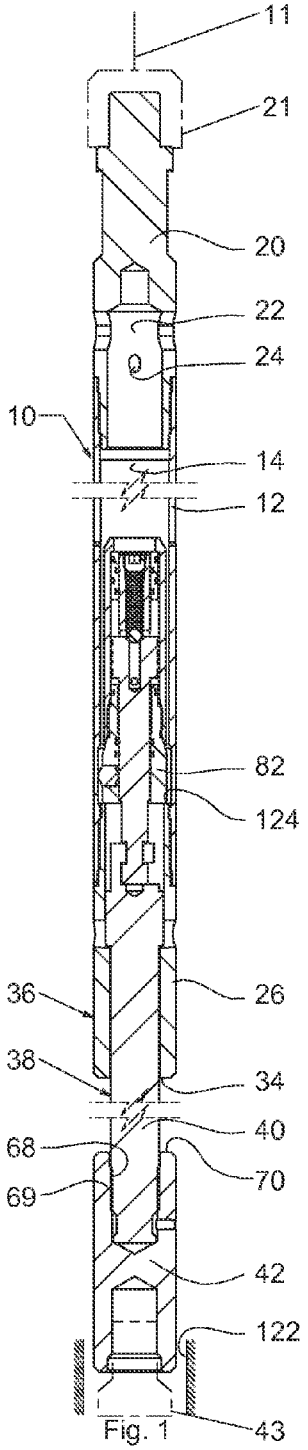
FIG. 1 is a side cross-section view of an example of a jar assembly in a fully extended re-cocked position and in accordance with the present invention.
Figure 2:
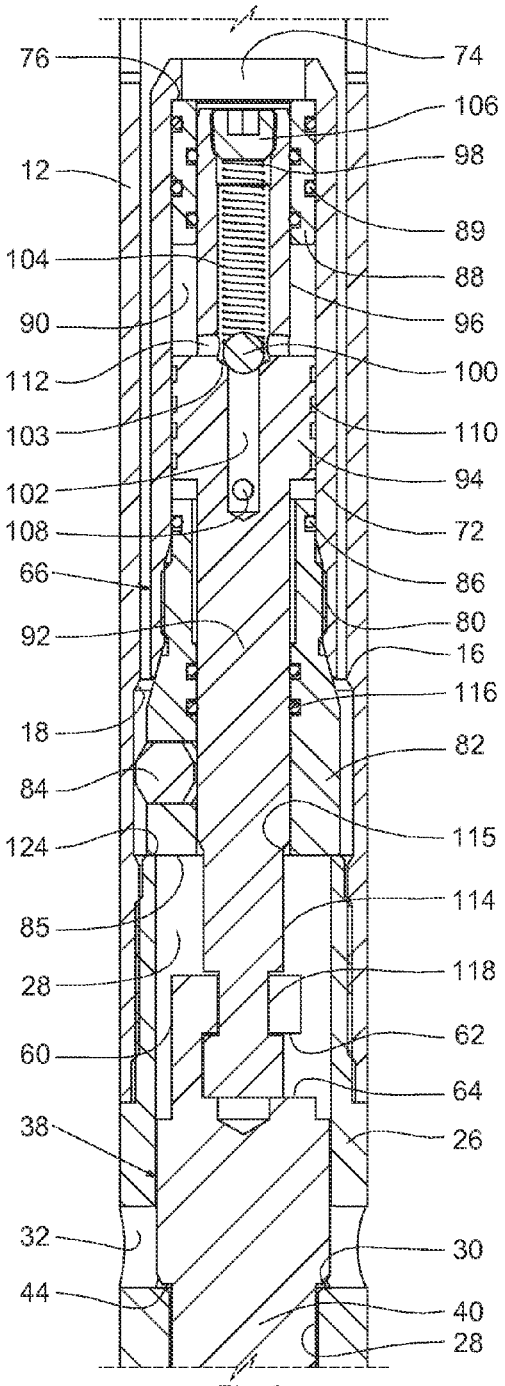
FIG. 2 is an enlarged view of a portion of FIG. 1.

Referring to FIGS. 1 and 2, an example of a jar assembly 10 is shown suspended on a line 11, where line 11 can be a wireline, slickline, tubing, or other conveyances means for deploying a tool in a wellbore. The example jar assembly 10 includes a tubular housing 12 with an axial bore 14, where bore 14 has a diameter that changes at a transition 16 to form a downward facing shoulder 18. An upper adapter 20 is shown having one end attached to a connector 21, and another end attached by threads to the upper end of housing 12. Examples of the connector 21 include a cablehead for connecting jar assembly 10 to line 11, as well as tool strings, weight bars, or any other device or assembly mountable on a downhole tool. Upper adapter 20 includes a central bore 22 and a side port 24 extending through the side wall of upper adapter 20. Upper adapter 20 is threaded for securing a string of tools and wire (not shown). Hammer 26 includes an axial bore 28 that changes to define an upward facing shoulder 30 near where a port 32 extends through a side wall of hammer 26. Located on hammer 26 below upward facing shoulder 30 is a downward facing shoulder 34. Hammer 26 is attached by threads to the lower end of housing 12. Ports 24, 32 allow wellbore fluids to move freely in an out of bore 14 of housing 12. An annular housing assembly 36 is shown circumscribing upper adapter 20, housing 12, and hammer 26.

Referring specifically to FIG. 2, shown is a mandrel assembly 38 which includes a generally cylindrical mandrel 40 and annular anvil 42. An end of mandrel 40 inserts into a cavity axially extending through an end of anvil 42, an end of mandrel 40 distal from anvil 42 inserts into hammer 26. A downhole tool 43 is shown connected to an end of end of anvil 42 opposite mandrel 40; examples of the downhole tool 43 include a perforating string, an imaging device, a packer assembly, and any other device used in a wellbore. In the illustrated examples, mandrel 40 has a diameter that increases proximate its upper end to define a downward facing shoulder 44. FIG. 1 shows mandrel 40 with downward facing shoulder 44 near upward facing shoulder 30 of hammer 26, and positioned to slide upward within bore 28 of hammer 26. The upper end of mandrel 40 is configured with a collar 60 with shoulders 62 and 64 for attachment of the lower end of a piston assembly 66. The lower end of mandrel 40 is secured with threads 68 to threads 69 on the upper end of anvil 42. Anvil 42 includes an upward facing ledge 70 on a surface circumscribing mandrel 40. An end of anvil 42 opposite where mandrel 40 couples is provided with a threaded bore for securing accessory tools (not shown) below jar assembly 10.

Still referring to FIG. 2, piston assembly 66 includes a cylinder 72 shown having a bore 74 axially formed therethrough, and where bore 74 has a diameter that transitions to form a downward facing shoulder 76. Threads 80 on a lower end of cylinder 72 secure to lug housing 82. Lug housing 82 includes a radially spaced slot 83 that contains a lug 84, optionally, as described below, the lug housing 82 can contain a plurality of slots 83 and lugs 84. As illustrated. seal 86 on an outer surface of lug housing 82 seals against the bore of cylinder 72. An annular balance valve 88 is positioned within the larger bore portion of cylinder 72 with its upper end near downward facing shoulder 76. Seals 89 circumscribe inner and outer surfaces of balance valve 88 and seal against the bore of cylinder 72. In an example embodiment, balance valve 88 maintains equilibrium between fluid reservoir 90 and ambient pressure.

Piston assembly 66 further includes an elongate piston 92 having a piston head 94 with a generally circular outer surface whose outer diameter contacts inner surface of bore 74. An annular piston extension sleeve 96 coaxially mounts on an end of piston head 94. A bore 98 is formed along an axis of piston extension sleeve 96. A spherically shaped ball 100 is illustrated resting in an end of bore 98 adjacent piston head 94. A portion of ball 100 extends into a bore 102 that projects axially through piston head 94 and that is generally coaxial with bore 98. Bore 102 flares radially outward adjacent the upper end of piston head 94 to define a seat 103. The diameter of bore 102 past seat 103 is less than the diameter of ball 100, so that ball 100 is supported in seat 103. A coiled spring 104 is shown inserted in bore 98 and having a lower end that exerts a biasing force against ball 100 that holds it in seat 103. A plug 106 threadingly inserts into an end of bore 98 opposite seat 103 and retains spring 104 within bore 98. A port 108 extends radially through the piston 92 from the bore 102 to the outer surface of the piston 92, the bore 102 is in communication with the reservoir 90 on a side of head 94 opposite ball 100. A groove is shown formed along an outer surface of the head 94 that follows a generally helical path to define a passage 110 between the head 94 and inner surface of cylinder 72. The passage 110 forms a communication pathway of fluid between head 94 and cylinder 72, wherein the cross sectional area of passage 110 regulates the flow rate of fluid flowing between upper and lower portions of the reservoir 90 as the head 94 reciprocates axially within cylinder 72. Side ports 112 are further illustrated that project radially from sleeve bore 98 through piston extension sleeve 96 and to its outer surface to communicate sleeve bore 98 with reservoir 90. Below head 94, piston 92 transitions radially inward to define an elongated piston body 114 shown depending downward and coupling to mandrel 40 via collar 60. A transition 115 on piston body 114 defines a diameter change of piston body 114. Seals 116 provide an axial flow barrier between piston body 114 and inner surface of lug housing 82.

Figure 7:
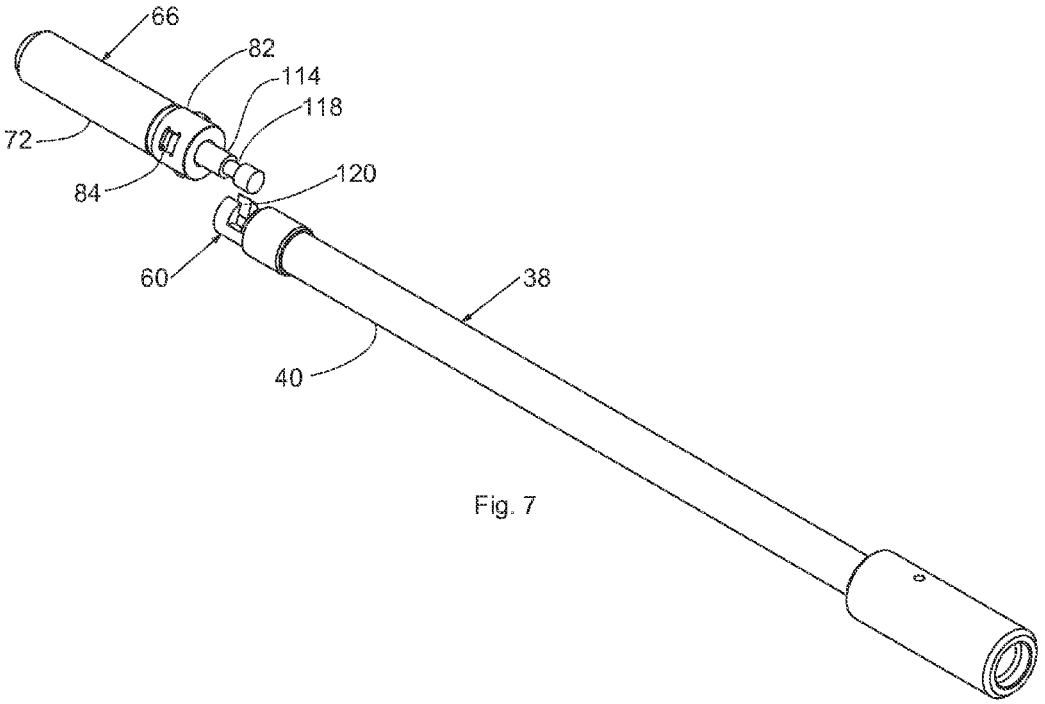
FIG. 7 is a perspective view of an example of a piston and mandrel assembly of the jar assembly of FIG. 1 and in accordance with the present invention.

Shown in perspective view in FIG. 7 is an example of piston assembly 66 detached from mandrel assembly 38. As shown, an annular channel 118 circumscribes a portion of piston body 114, where the reduced diameter of channel 118 is received in a gap 120 that projects radially through a portion of collar 60. The portion of the collar 60 having gap 120 is supported by an axial pedestal that projects axially from mandrel 40. In this example, the piston assembly 66 axially couples to mandrel assembly 38 while still rotatable about mandrel assembly 38.

Figure 3:
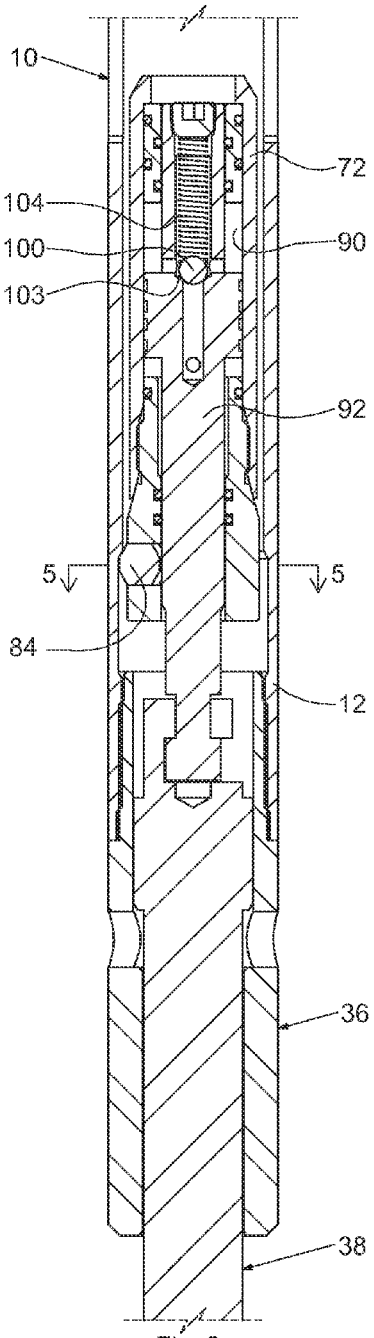
FIG. 3 is a side cross-section portion view of the jar assembly of FIG. 1 in an engaged position.
Figure 4:
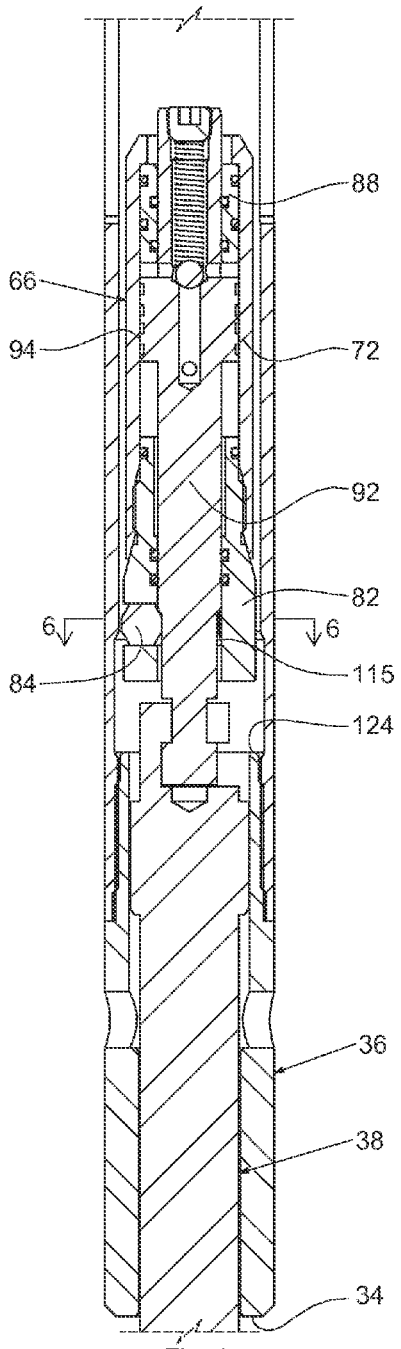
FIG. 4 is a side cross-section portion view of the jar assembly of FIG. 1 in a released position.
Figure 5:
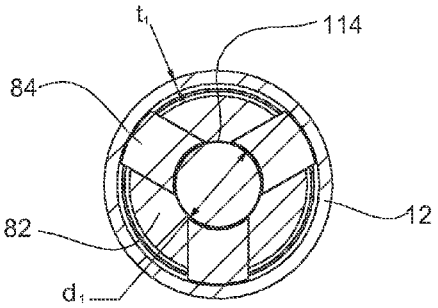
FIG. 5 is a sectional view of the jar assembly of FIG. 3 taken along the line 5-5.
Figure 6:
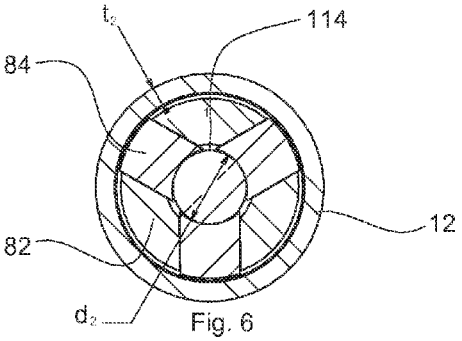
FIG. 6 is a sectional view of the jar assembly of FIG. 4 taken along the line 6-6.

In an example of operation of the jar assembly 10 (FIG. 1), the jar assembly 10 is disposed in a wellbore 122, and anvil 42 or the string (not shown) secured to the lower end of anvil 42 becomes lodged against a sidewall of the wellbore 122 so that mandrel assembly 38 is supported in wellbore 122 and held axially stationary. Reducing tension in line 11, such as by unspooling more line, thus allows housing 12 and attached hammer 26 to axially slide downward with respect to cylinder 72 and lug housing 82 (FIG. 2). Ultimately and as illustrated in FIG. 3, housing 12 is lowered enough so that downward facing shoulder 18 comes into contact with an outer surface of lug 84. In FIGS. 1-3, housing 12, and attached elements, are supported by cylinder 72 by virtue of contact between the shoulder 18 and lug 84. Referring now to FIGS. 3 and 4, the weight of housing 12, adapter 20, and elements of connector 21, in addition to the weight of cylinder 72, generates a downward force on balance valve 88 that forces fluid in the portion of reservoir 90 above head 94, through the passage 110, and to the portion of reservoir 90 below head 94. As illustrated in FIG. 4, displacing the fluid to the portion of reservoir 90 below head 94 in turn generates a force onto piston head 94 to urge piston 92 axially with respect to cylinder 72 and lug housing 82. Continued upward movement of piston 92 positions the reduced diameter portion of piston body 114 adjacent lug 84. In the configuration of FIGS. 3 and 5, the larger diameter portion of piston body 114 provides a backstop for lugs 84, so that lugs 84 remain in interference with shoulder 18 to prevent downward relative displacement of housing 12 with respect to cylinder 72. By urging piston body 114 upward to allow radial inward movement of lugs 84, as illustrated in FIGS. 4 and 6, lugs 84 are not in interference with housing 12 so that housing 12 is decoupled from cylinder 72 and axially moveable with respect to cylinder 72. Comparatively illustrated in FIGS. 5 and 6 is that the thickness ($t_1$) of housing 12 of FIG. 5 is less than the thickness ($t_2$) of housing 12 of FIG. 6; and that the diameter ($d_1$) of piston body 114 of FIG. 5 is greater than the diameter ($d_2$) of piston body 114 of FIG. 6.

Decoupling housing 12 from cylinder 72, while at the same time removing tension from line 11, allows the housing 12 to free fall within wellbore 122 (FIG. 1). As the mandrel assembly 38 is supported by wellbore 122, anvil 42 is also stationary in wellbore 122. Thus the housing 12 will ultimately land on anvil 42 and create an impact for jarring portions of the tool string coupled to jar assembly 10. In an example embodiment, the amount of time required for the fluid to flow from one side of the piston head 94, through the passage 110, and to the other side of the piston head 94 can be regulated based on viscosity of the fluid, cross sectional area of the passage 110, and length of the passage 110. Optionally, one or more restrictions (not shown) can be positioned in the passage 110 for restricting or regulating flow through the passage 110 and thereby controlling the time period for activating the jarring feature of the jar assembly 10.

Jar assembly 10 can be "recocked" by exerting an upward force onto housing 12 to raise housing 12 without also raising mandrel assembly 38. One example of exerting an upward force onto housing 20 includes tensioning line 11. As shown in FIG. 2, continued upward displacement of housing 12 upwardly draws attached hammer 26 so that an upper end 124 of hammer 26 contacts a lower surface of lug housing 82. The upward urging of lug housing 82 forces fluid from the portion of the reservoir 90 below head 94 to the portion of reservoir 90 above head 94 (FIG. 3). In this recocking example of operation, the fluid flows through port 108 and up bore 102 where it unseats ball 100. From bore 102, fluid flows past ball 100 and through ports 112 into the portion of reservoir 90 above head 94. An advantage of the ball 100 and spring 104 assembly is the ability to avoid the restricted flow path of the passage 110.

Raising lug housing 82 also raises lug 84 upward past transition 115 so that the larger diameter portion of piston body 114 is adjacent lug 84 thereby urging it radially outward (FIG. 5). Interference between upward facing shoulder 30 and downward facing shoulder 44 limits additional upward movement of lug housing 82 with respect to housing 12. Downward telescoping of mandrel assembly 38 with respect to housing 12 is limited by interference between the shoulder 44 of mandrel 40 and upward facing shoulder 30 of hammer 26. Embodiments of the jar assembly 10 disclosed herein advantageously provide a slow downward mechanical disengagement impeded by hydraulic metering and unimpeded upward mechanical re-engagement between housing assembly 36 and piston assembly 66.

Figure 8:
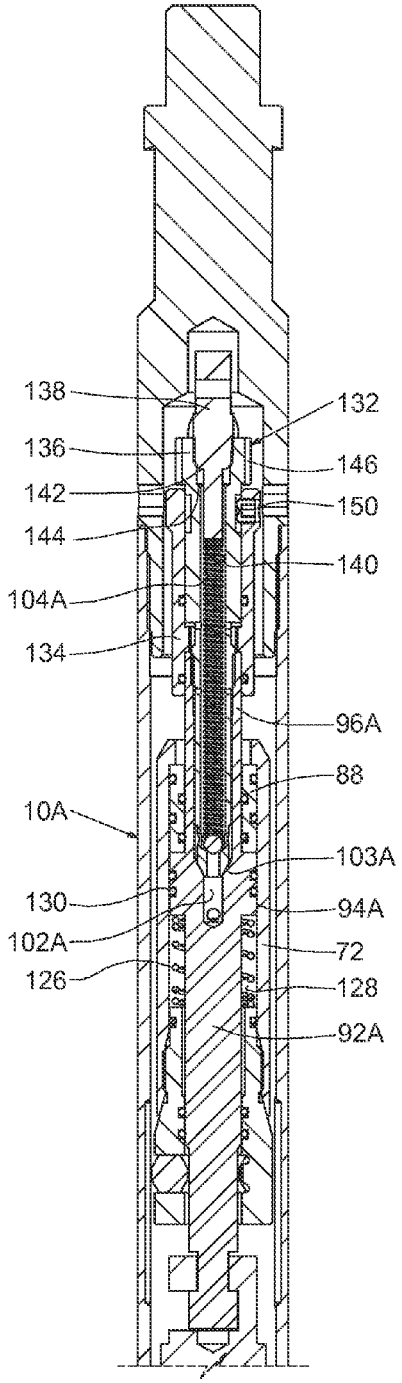
FIG. 8 is a side sectional view of an example of an alternate embodiment of the jar assembly of FIG. 1.

Referring now to FIG. 8, shown in a side section view is an optional embodiment of the jar assembly 10A which includes a compression spring 126 disposed in an annular space 128 formed between piston 92A and cylinder 72 and on a side of head 94A opposite balance valve 88. An advantage of the compression spring 126 is that the cylinder 72 is prevented from prematurely moving toward the recock position and the lugs 84 from dragging in the housing assembly 36. Also in the jar assembly 10A of FIG. 8 are seals 130 circumscribing an outer surface of the head 94A that form a sealing interface between the outer circumference of the head 94A and inner surface of cylinder 72 and blocks bypass of fluid axially along piston 92A.

Figure 9:
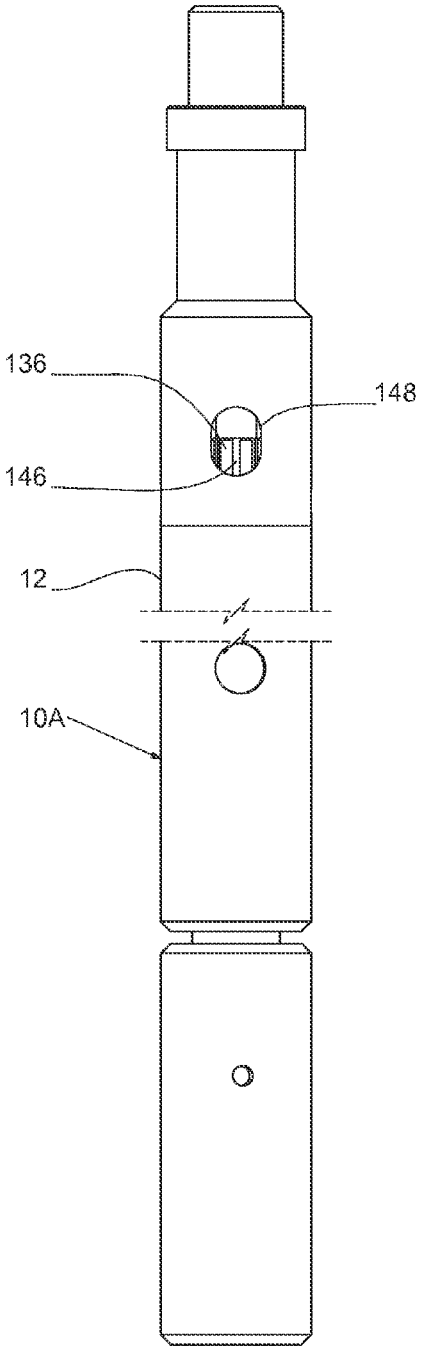
FIG. 9 is a side view of the jar assembly of FIG. 8 and in an assembled configuration.

Also illustrated in FIG. 8 is an embodiment of a valve assembly 132 set within the jar assembly 10A; and which includes an adjuster sub 134, a valve 136, and fill plug 138. The adjuster sub 134 is an annular member with an axial bore, in which the lower end threadingly receives an upper end of the piston extension sleeve 96A. The valve 136, which in the example shown is an annular member and coaxial with the adjuster sub 134, threadingly inserts into an end of the adjuster sub 134 distal from the extension sleeve 96A. Valve 136 projects downwardly through a bore in piston extension sleeve 96A and has a lower terminal end shown set against valve seat 103A. A decreased diameter portion of the axial bore in the adjuster sub 134 defines downward and upward facing shoulders that respectively provide stops for the extension sleeve 96A and valve 136. An axial bore is also provided in valve 136 which receives an upper end of spring 104A and is communication with a bore 140 in piston extension sleeve 96A. Plug 138 is an elongate member with an outer curved surface, and having a varying diameter that defines a downward facing shoulder 142 along its outer surface. Bore 140 also has a diameter that transitions radially inward to define an upward facing shoulder 144 that interferes with downward facing shoulder 142 and limits axial travel of plug 138. Diameter of bore 140 below upward facing shoulder 144 is greater than the portion of plug 138 below downward facing shoulder 142 so that this portion of plug 138 can reciprocate within bore 140. A lower end of plug 138 rests on an upper end of spring 104A and which exerts an upward biasing force onto plug 138. The outer surface of the valve 136 above upper facing shoulder 142 is profiled with axial elongate protrusions that define ridges 146. The ridges 146 are accessible via a window 148 (FIG. 9) and provide a contact surface for rotating the valve 136, which in turn axially repositions valve 136 within jar assembly 10A via its threaded connection. In an example of operation, valve 136 can be rotated through the window 148 to adjust a flow area between the lower end of valve 136 and valve seat 103A. In the example of FIG. 8, fluid flows from reservoir 90 to annular space 128 via bore 102A as piston 92A is being moved upward. As such, adjusting the flow area affects the time interval for the releasing event to take place. Optional set screws 150 are shown threaded into bores that extend radially through the adjuster sub 134 into selective contact with an outer surface of valve 136. Thus by loosening set screws 150, the valve 136 is free to rotate by engaging the ridges 146. Referring now to FIG. 9, an advantage of the example of the jar assembly 10A, is that the set screws 150 (FIG. 8) and valve 136 can be accessed readily through the window 148 and without disassembly such as removal of any components, including the housing 12.

Figure 10:
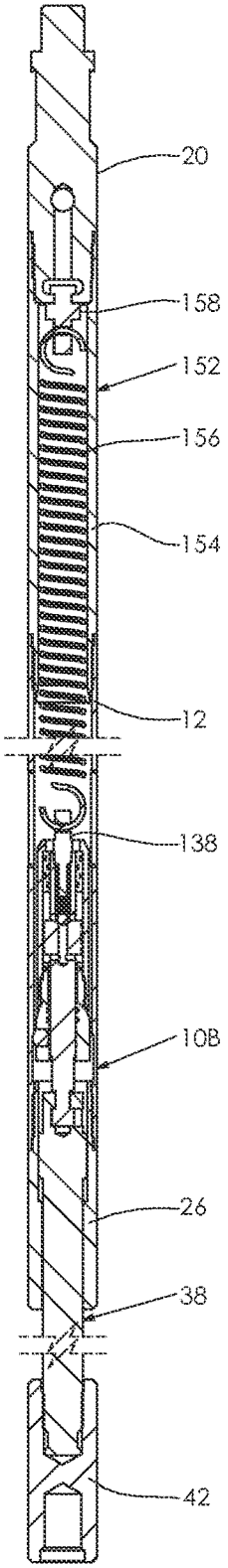
FIGS. 10 and 11 are side sectional views of an alternate embodiment of the jar assembly of FIG. 1 having an accelerator assembly.
Figure 11:
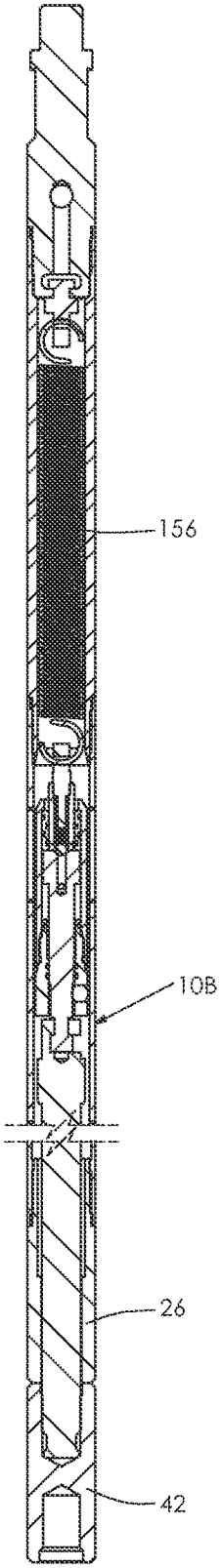

Illustrated in side sectional view in FIGS. 10 and 11 is an alternate embodiment of the jar assembly 10B having an accelerator assembly 152 and respectively in a cocked and un-cocked configuration. The accelerator assembly 152 is coupled between an upper end of housing 12 and lower end of upper adapter 20. In the illustrated example, the accelerator assembly 152 includes an elongate accelerator assembly housing 154, which has a tubular shape and threads on opposing ends for engaging housing 12 and upper adapter 20. A spring 156 is provided in the accelerator assembly housing 154, and is shown having an end coupled to fill plug 138; a lower terminal end of spring 156 inserts into an opening radially formed through plug 138. An upper end of spring 156 couples with upper adapter 20 via a connector 158 that attaches to a lower end of upper adapter 20. Similarly, an upper terminal end of spring inserts through a bore formed radially through connector 158 thereby elastically engaging upper adapter 20 with mandrel assembly 38. It is pointed out that alternate embodiments exist wherein spring 156 can be replaced with an elastic member. The embodiment of the jar assembly 10B of FIG. 10 is in the cocked configuration so that the hammer 26 and anvil 42 are spaced axially apart. Further illustrated is that the spring 156 is in tension and stretched from supporting the mandrel assembly 38, anvil 42, and other elements of the string coupled with the mandrel assembly 38. The spring 156 in tension stores additional potential energy for drawing together the hammer 26 and anvil 42 and increasing the speed of the mandrel assembly 38 and hammer 26 during the uncocking step, thereby increasing the force resulting from impact between the hammer 26 and anvil 42.

Referring now to FIG. 11, the jar assembly 10B is in the un-cocked configuration with the hammer 26 in contact with the anvil 42, and wherein spring 156 is no longer in tension as the potential energy stored in the elongated spring 156 of FIG. 10 has contributed to the force of impact between the hammer 26 and anvil 42. An advantage of the accelerator assembly 152 is the increased rate of speed after the release event occurs in turn delivering a greater impact force. Moreover, like the adjustment feature of the valve 136 of FIG. 9, the accelerator assembly 152 can be added or removed externally and without disassembly (other than the upper adapter 20) of the jar assembly 10B.

The design of known jars makes it impractical for them to be modified to function in the opposite direction. The oil or hydraulic jar utilizes a piston and rod configuration whereby the piston is pulled through a tight fitting cylinder and into a larger bore of the cylinder where the free stroke occurs. To accomplish resistance to the strain placed on the rod via the wire, oil is metered past the piston at a slow rate when located in the tight fitting section of the cylinder. The oil filled cylinder is isolated from the well bore by sealing around the rod, therefore the rod is stripped through seals and the piston is surrounded by oil. These two factors would impede a downward free falling motion. Other types of upward acting jars are set to release or unlock at a predetermined load. The tool string weight could be adjusted to overcome a pre-set load. However, the release or unlocking takes place instantly upon application of the load. Due to the instant release, there would not be sufficient time to fully slacken the wire prior to the occurrence of the release.

Embodiments described herein produce a downward impact without the need to rotate the winch rapidly. In one example, when raised to the extent of the free stroke, the wireline down jar automatically locks in the extended position. A hydraulic metering device delays unlocking and closure while the wireline is lowered to transmit the weight of the tool string to the wireline down jar. Once the wire is slackened, the hydraulic metering device begins moving at a controlled rate due to the weight exerted by the tool string. At a specific point in the movement, the hydraulic metering device unlocks dropping the mass of the tool string to create an impact. The hydraulic metering device is self-contained and does not require seals on the free stroking rod. The mass of the tool string does not need to be pre-determined for the wireline down jar to function. The weight of the tool string though does affect the time interval required for the unlocking event to occur. The time interval can be adjusted to accommodate various tool string weights by changing the by-pass area around a piston or changing oil viscosity.

Slowly lowering the wire advantageously allows the mass of the tool string to come to rest on the locked open jar subsequent to the wire stripping through the pack off. Additionally, sufficient time is given to allow complete slackening of the wire prior to the unlocking event thus maximizing potential energy prior to the mass of the tool string dropping. Embodiments described herein solve common problems associated with delivering a downward impact when wireline is the source of conveyance: such as reducing the level of skill required, not requiring rapid manipulation of the winch, increasing impact efficiency, and reducing potential damage to the wire.

The invention claimed is:

1. A jar assembly for use in a wellbore comprising:

an annular housing;

an elongated mandrel in selective telescoping relationship with the housing;

an anvil coupled with an end of the mandrel and selectively coupled with a downhole tool;

an annular cylinder slideably disposed within the housing:

a fluid reservoir defined in the cylinder and containing a fluid;

a piston comprising: a head portion slideably disposed in the fluid reservoir, and a body portion attached to the head portion, the body portion coupled with the mandrel and having a transition defining a change of diameter of the body portion;

a downward facing shoulder on an inner surface of the housing; and a lug coupled with the cylinder that is radially moveable with respect to the cylinder and axially slideable along the transition, and that is in selective interfering contact with the shoulder when the lug is adjacent a larger diameter portion of the body, and is moved out of interfering contact with the shoulder when the lug is moved past the transition, so that when the mandrel is supported in the wellbore the housing slides axially downward into contact with the lug to transfer a force that urges the fluid through a passage formed in the piston head to a side of the piston head proximate the lug, that in turn urges the transition past the lug so the lug moves radially inward and out of interfering contact with the shoulder so that the housing slides axially downhole and into jarring contact with the anvil.

2. The jar assembly of claim 1, wherein the passage formed in the piston head is configured so that portions of the reservoir on opposing sides of the piston head are in fluid communication.

3. The jar assembly of claim 2, wherein when the passage is formed along an outer circumference the piston head and along a helical path.

4. The jar assembly of claim 1, wherein the lug is disposed in a slot that is formed radially in a lug housing that threadingly engages a downhole end of the housing, and has a bore that receives the piston body.

5. The jar assembly of claim 1, further comprising an annular balance valve that is slideably within an end of the cylinder distal from the mandrel and that defines a terminal end of the fluid reservoir.

6. The jar assembly of claim 5, further comprising an annular extension sleeve mounted to a surface of the piston head facing the balance valve and that is axially reciprocal within a bore in the balance valve.

7. The jar assembly of claim 6, further comprising a spring in the extension sleeve, an axial bore in the piston head having an end in communication with a portion of the fluid reservoir distal from the extension sleeve, a seat formed where axial the bore intersects with a surface of the piston head adjacent the extension sleeve, a ball disposed in the seat and in contact with the spring, sideports formed radially through sidewalls of the extension sleeve adjacent the ball, so that when pressure in the axial bore exceeds pressure in the sideports, the ball is urged from the seat and against the spring so that fluid flows a side of the fluid reservoir distal from the ball to a side of the fluid reservoir adjacent the ball.

8. The jar assembly of claim 1, wherein a conveyance means for deployment within a wellbore is coupled with the housing and comprises a wireline.

9. The jar assembly of claim 1, wherein the piston is rotatable with respect to the mandrel.

10. The jar assembly of claim 1, further comprising an accelerator assembly that comprises an elastic member having an end coupled with the mandrel and is in tension when the mandrel is spaced away from the anvil, and that increases a rate of the mandrel.

11. A jar assembly for use downhole comprising:

an annular housing having an inner diameter with a downward facing shoulder;

an elongated mandrel;

an anvil mounted on an end of the mandrel;

a cylinder axially moveable within the housing:

a piston having a piston head slideably disposed in the cylinder and a piston body depending from the piston head, the piston body having a reduced diameter portion, a larger diameter portion, and a transition between the reduced and larger diameter portions;

a lug slideably disposed in a radially oriented slot that is axially coupled with the cylinder, the lug having a radially outward end that is in selective interfering contact with the downward facing shoulder and a radially inward end in sliding contact with the piston body, so that when the housing is moved axially downhole and the downward facing shoulder is in contact with the radially outward end of the lug, a force is applied to the lug; and a means for transferring the force applied to the lug to a surface of the piston head proximate the piston body to slide the piston body so that the lug is adjacent the reduced diameter portion and moves radially inward out of interfering contact with the downward facing shoulder so that when the mandrel is supported in the wellbore, the housing slides axially downward into contact with the lug to transfer a force that urges the fluid through a passage formed in the piston head to a side of the piston head proximate the lug, so that the housing moves into jarring contact with the anvil.

12. The jar assembly of claim 11, wherein the means for transferring the force applied to the lug comprises an annular balance valve set coaxially within an end of the cylinder distal from the piston head, a fluid reservoir in the cylinder and in which the piston head reciprocates, wherein the fluid passage formed along the piston head provides fluid communication between opposing axial surfaces of the piston head.

13. The jar assembly of claim 12, wherein the passage follows a helical path and is disposed proximate an outer radius of the piston head.

14. The jar assembly of claim 11, wherein lowering the housing in a wellbore and supporting the mandrel on a sidewall of the wellbore initiates axial movement of the housing to contact the downward facing shoulder with the lug.

15. The jar assembly of claim 11, further comprising an accelerator for increasing a speed of the mandrel when the mandrel strikes the anvil.

16. A method of applying a jarring impact downhole comprising:

a. lowering a jar assembly into a wellbore, the jar assembly comprising a piston comprising a piston head, and a piston body with a reduced diameter portion and a larger diameter portion, a mandrel rotatingly coupled to an end of the reduced diameter portion distal from the piston head, a housing axially moveable with respect to the mandrel, a downward facing shoulder on an inner surface of the housing, an anvil on an end of the mandrel; an annular cylinder inserted in housing, a fluid reservoir in the cylinder in which the piston head is axially reciprocatable, and a lug that is radially moveable having a radial outward end in selective interfering contact with the shoulder, and a radial inward end in sliding contact with the piston body:

b. providing slack in the line supporting the jar assembly by positioning the jar assembly downhole so that the weight of the housing is supported by the mandrel;

c. sliding the housing downhole so that the downward facing shoulder is in interfering contact with the lug and applies a force to the lug;

d. urging the piston uphole in response to the step of transferring the force applied to the lug so that the lug is disposed adjacent to the reduced diameter portion of the piston body and moves radially inward and out of interfering contact with the downward facing shoulder so that when the mandrel is supported in the wellbore, the housing slides axially downward into contact with the lug to transfer a force that urges the fluid through a passage formed in the piston head to a side of the piston head proximate the lug; and e. sliding the housing downhole with respect to the mandrel and into jarring impact with the anvil.

17. The method of claim 16, further comprising controlling the time period for activating the jarring feature of the jar assembly by regulating a flow of fluid between opposing surfaces of the piston head.

18. The method of claim 16, further comprising mounting a downhole tool to the jar assembly.

19. The method of claim 16, further comprising recocking the jar assembly by raising the jar assembly.

20. The method of claim 16, wherein the step of urging the piston uphole comprises forcing fluid from a surface of the piston head that is proximate the piston body through the passage and to a surface of the piston head that is distal from the piston body, and regulating the flow of fluid through the passage.

* * * * *